US006306226B1

(12) United States Patent
Iino et al.

(10) Patent No.: US 6,306,226 B1
(45) Date of Patent: Oct. 23, 2001

(54) PROCESS FOR SURFACE-TREATING AN ALUMINUM-CONTAINING METAL

(75) Inventors: Yasuo Iino; Hiroki Kojima; Tomohiro Ohsako, all of Tokyo; Hiroyoshi Sugawara, Toyota; Kengo Kobayashi, Nagoya, all of (JP)

(73) Assignees: Nihon Papkerizing Co., Ltd., Tokyo; Denso Corporation, Kariya, both of (JP)

( * ) Notice: Subject to any disclaimer, the term of this patent is extended or adjusted under 35 U.S.C. 154(b) by 0 days.

(21) Appl. No.: 09/177,577

(22) Filed: Oct. 23, 1998

(30) Foreign Application Priority Data

Oct. 24, 1997 (JP) ..... 9-292931

(51) Int. Cl.[7] ..... C23C 22/48

(52) U.S. Cl. ..... 148/247; 148/251; 148/261; 148/275; 427/409

(58) Field of Search ..... 148/247, 251, 148/261, 275; 427/409

(56) References Cited

U.S. PATENT DOCUMENTS

| | | | | |
|---|---|---|---|---|
| 2,438,877 | | 3/1948 | Spruance . | |
| 3,658,581 | | 4/1972 | Paul et al. . | |
| 4,830,101 | * | 5/1989 | Ohara et al. | 427/409 |
| 5,052,421 | * | 10/1991 | McMillen | 148/275 |
| 5,538,078 | | 7/1996 | Mizuno et al. . | |
| 5,614,585 | * | 3/1997 | Matsukawa et al. | 148/251 |

FOREIGN PATENT DOCUMENTS

| | | |
|---|---|---|
| 0 178 020 | 4/1986 | (EP) . |
| 0 200 546 | 11/1986 | (EP) . |
| 0 623 653 | 11/1994 | (EP) . |
| 0 676 250 | 10/1995 | (EP) . |
| 2295828 | 6/1996 | (GB) . |
| 61 250495 | 11/1986 | (JP) . |
| 2-1031133 | 4/1990 | (JP) . |
| 4-148196 | 5/1992 | (JP) . |
| 7-048682 | 2/1995 | (JP) . |

OTHER PUBLICATIONS

Merriman, A.D., "A Dictionary of Metallurgy", MacDonald & Evans, Ltd., London, pp. 79–80, 1958 (No Month Date Available).*

Patent Abstracts of Japan, vol. 095, No. 005, Jun. 30, 1995 & JP 07 048682 A (Calsonic Corp), Feb. 21, 1995.

* cited by examiner

*Primary Examiner*—Roy King
*Assistant Examiner*—Andrew L. Oltmans
(74) *Attorney, Agent, or Firm*—Pillsbury Winthrop LLP

(57) ABSTRACT

An aluminum-containing metal material for, for example, a heat-exchanger for motorcars is surface-treated by chemically etching an Al-containing metal material surface, forming a first protective layer on the etched surface by a chemical conversion treatment with an aqueous solution of Zr phosphate or Ti phosphate, and coating the first protective layer with a second protective layer containing a hydrophilic resin including non-cross-linked hydrophilic functional groups and at least partially cross-linked reactive functional groups different from the hydrophilic functional groups, to impart high hydrophilicity and resistance to odor generation and corrosion to the aluminum-containing metal material surface.

6 Claims, No Drawings

PROCESS FOR SURFACE-TREATING AN ALUMINUM-CONTAINING METAL

BACKGROUND OF THE INVENTION

1. Field of the Invention

The present invention relates to a process for surface-treating an aluminum-containing material, particularly a heat-exchanger having heat-exchanging tubes and fins comprising aluminum or an aluminum alloy and usable as a part of an air conditioner for motorcars.

2. Description of the Related Art

Conventional heat exchangers having heat-exchanging tubes and fins comprising aluminum or an aluminum alloy are mostly designed so that the surface areas of heat-radiating portions and cooling portions are as large as possible, to obtain excellent heat-radiation or cooling effects in a limited space. Therefore, the gaps between the fins are very small. Also, to decrease air resistance of the heat exchanger to as low as possible, the fins are notched. The notched fin is referred to as a fin louver.

When the above-mentioned heat exchangers are used for cooling, the moisture contained in air is condensed on the surface of the heat exchanger to form water drops which fill the gaps between the fins to increase the air resistance of the heat exchanger, and thus the heat-exchanging efficiency of the heat-exchanger is decreased.

Also, the condensed water drops cause corrosion of aluminum or aluminum alloy in the heat exchanger, and thus a fine white powder of aluminum oxide is generated on the fin surfaces. When the heat exchanger surface is kept in a wetted condition for long time, mold easily grows on the fin surfaces.

The white aluminum oxide powder formed on the fin surfaces and the water drops condensed between the fins are scattered by an air blower into the passenger compartment of the motorcar, and the mold grown on the fin surfaces generates mold odor, to give the occupants an unpleasant feeling.

As a surface treatment for a purpose of preventing a corrosion of the aluminum or aluminum alloy heat exchanger, a chromic acid-chromate chemical conversion treatment and a phosphoric acid-chromate chemical conversion treatment are known. The chromic acid-chromate chemical conversion treatment was practically utilized from about 1950 and is still widely used for the fin materials of heat exchangers, etc. This chemical conversion treatment liquid contains, as main components, chromic acid ($CrO_3$) and hydrofluoric acid (HF), and further an accelerator, and can form a chemical conversion coating containing a small amount of hexavalent chromium. The phosphoric acid-chromate chemical conversion treatment is based on the invention of U.S. Pat. No. 2,438,877, and the treatment liquid thereof comprises chromic acid ($CrO_3$), phosphoric acid ($H_3PO_4$) and hydrofluoric acid (HF). The resultant chemical conversion coating contains, as a principal component, hydrated chromium phosphate ($CrPO_4 \cdot 4H_2O$).

To prevent the blockage of the heat exchanger by the water drops remaining in the gaps between the fins, treatment methods for imparting a high hydrophilicity to the fin surfaces and for enhancing the water-wetting property of the fin surfaces have been developed. In these methods, a hydrophilic coating is formed from hydrophilic inorganic compounds, for example, water glass and silica gel, and organic compounds, for example, surfactants and water-soluble resin, which may be used alone or in a mixture of two or more thereof, on a surface of corrosion resistant coating for example, phosphoric acid-chromate coating or chromic acid-chromate coating.

For example, Japanese Unexamined Patent Publication No. 61-250,495 discloses an aluminum heat exchanger and a process for producing the same.

This process is characterized in that a hydrophilic coating comprising, as a principal component, a water-soluble polyamide resin exhibiting a cationic property in an aqueous solution thereof is formed on a chemical conversion coating such as chromate coating. This process is, however, disadvantageous in that the coating procedure causes a waste liquid containing hexavalent chromium ($Cr^{6+}$) to be discharged. Since the chromate type surface treatment uses an aqueous treatment liquid containing harmful hexavalent chromium, there is a strong demand for a new treatment liquid containing no hexavalent chromium, to prevent environmental pollution. Also, since the above-mentioned waste liquid is not allowed to be discharged without a hexavalent chromium-removing treatment, the waste liquid must be treated by a treatment apparatus using treatment reagents which causes the resultant product to be expensive.

To solve the above-mentioned problem, for example, Japanese Unexamined Patent Publication No. 7-48,682 discloses a surface treatment process for an aluminum heat exchanger comprising the steps of forming a surface treatment layer on the aluminum surface by an anti-rust agent selected from water-soluble polyaminepolyamide resin-tannic acid-titanium compositions, water-soluble polyamide resin-tannic acid-zirconium compositions, water-soluble acryl-styrene copolymer resin-phytic acid-zirconium compositions, polyvinyl alcohol-tannic acid-lithium compositions, tannic acid-titanium compositions, tannic acid, zirconium compositions, tannic acid-lithium compositions, phytic acid-lithium compositions, phytic acid zirconium compositions, phytic acid-titanium compositions and silane-coupling agents; and optionally forming a hydrophilic coating layer containing an antibacterial agent on the surface treatment layer.

By applying the above-mentioned process, the problem of the waste liquid containing the hexavalent chromium ($Cr^{6+}$) can be solved, and the treatment cost including the treatment apparatus cost and the treatment reagent cost can be saved.

However, generally, the non-chromate coating exhibits a lower corrosion resistance than that of the chromate coating. Therefore, in the aluminum heat exchanger obtained in accordance with the process disclosed in the Japanese unexamined patent publication by passing through the surface treatment procedure using, as a chemical conversion coating, the non-chromate coating, when water-absorption and swelling and then drying are repeatedly applied to the heat exchanger by the drying cycle, the formed coating is deteriorated and thus, the coating is partly peeled away to create defective portions, an odor is generated due to the metal or metal oxides exposed in the defective portions, and the odor is blown into the inner room space of the motorcar by the air blower attached to the heat exchanger to give the occupants in the motorcar an unpleasant feeling. The above-mentioned disadvantages have not yet been overcome.

Accordingly, at the present time, there is no process for surface-treating an aluminum heat exchanger with a non-chromate treating liquid, so that the resultant treated surface can maintain high hydrophilicity, corrosion resistance and resistance to odor-generation over a long period, and the waste liquid-treating cost is reduced.

SUMMARY OF THE INVENTION

An object of the present invention is to provide a process for surface-treating an aluminum-containing metal material, particularly an aluminum or aluminum alloy-containing heat exchanger, to form a surface coating capable of maintaining excellent hydrophilicity, corrosion resistance and odor generation-preventing property over a long period.

Another object of the present invention is to provide a process for surface treating an aluminum-containing metal material, particularly an aluminum or aluminum alloy-containing heat exchanger with a non-chromate treating liquid, while preventing generation of a waste water containing hexavalent chromium ($Cr^{6+}$) and decreasing the waste water-treatment cost.

The process of the present invention can solve the above-mentioned problems of the conventional surface treatment methods for the aluminum-containing metal materials.

The above-mentioned objects can be attained by the process of the present invention, for surface-treating an aluminum-containing metal material, which comprises the steps of:

chemically etching at least a portion of a surface of an aluminum-containing metal material;

applying a chemical conversion treatment to the chemically etched surface of the aluminum-containing metal material, with a chemical conversion treating liquid containing at least one member selected from the group consisting of zirconium phosphate and titanium phosphate, to form a first protective layer; and forming a second protective layer containing a hydrophilic resin on the first protective layer, wherein the hydrophilic resin contained in the second protective layer comprises at least one polymer having at least one type of non-cross-linked hydrophilic functional groups and at least one type of reactive functional groups different from the hydrophilic functional groups, at least a portion of the reactive functional groups being cross-linked.

In an embodiment of the surface-treating process of the present invention for the aluminum-containing metal material, the second protective layer is formed by coating the first protective layer with a resin treating liquid comprising at least one polymer having one or more types of hydrophilic functional groups and one or more types of reactive functional groups different from the hydrophilic functional groups and a cross-linking agent comprising at least one cross-linking compound reactive to the reactive functional groups but not reactive to the hydrophilic functional groups; and heat-drying the resultant resin treating liquid layer.

In another embodiment of the surface-treating process of the present invention for the aluminum-containing metal material, the second protective layer is formed by coating the first protective layer with a resin treating liquid containing at least one hydrophilic polymer having one or more types of hydrophilic functional groups, at least one reactive polymer having one or more types of reactive functional groups different from the hydrophilic functional groups, and a cross-linking agent comprising at least one cross-linking compound reactive to the reactive functional groups but not reactive to the hydrophilic functional groups; and heat-drying the resultant resin treating liquid layer.

In still another embodiment of the surface-treating process of the present invention for the aluminum-containing metal material, the second protective layer is formed by coating the first protective layer with a resin treating liquid containing a cross-liquid agent comprising at least one cross-linking compound having one or more types of hydrophilic functional groups and one or more types of cross-linking functional groups non-reactive to the hydrophilic functional groups, and at least one polymer having one or more types of reactive functional groups different from the hydrophilic functional groups of the cross-linking compound and reactive to the cross-linking functional groups of the cross-linking compound; and heat-drying the resultant resin treating liquid layer.

In the surface-treating process of the present invention for the aluminum-containing metal material, the aluminum-containing metal material may be a heat-exchanger having solder-bonded tubes and fins comprising aluminum or an aluminum alloy.

In the surface-treating process of the present invention, for the aluminum-containing metal material, the aluminum-containing metal material preferably exhibits a reduction in weight of 0.02 to 20 $g/m^2$ by the chemical etching step.

In the surface-treating process of the present invention, for the aluminum-containing metal material, the chemical etching step is preferably carried out by using an aqueous acid solution containing at least one member selected from the group consisting of sulfuric acid, hydrofluoric acid, nitric acid, and phosphoric acid, or an aqueous alkaline solution containing at least one member selected from the group consisting of sodium hydroxide, potassium hydroxide and alkali metal phosphates.

DESCRIPTION OF THE PREFERRED EMBODIMENTS

The inventors of the present invention have extensively studied a means for solving the problems of the conventional surface-treating processes as mentioned above. As a result, the inventors have found that in the surface-treating process for an aluminum-containing metal material, particularly a heat exchanger comprising aluminum or aluminum alloy tubes and fins, a coating capable of maintaining an excellent hydrophilicity, a high odor generation-preventing property and a superior corrosion resistance over a long period can be formed on the aluminum-containing metal material surface by applying a specific chemical etching treatment to the surface, forming a first protective layer free from hexavalent chromium on the chemically etched surface by a chemical conversion treatment with a chemical conversion treating liquid containing zirconium phosphate and/or titanium phosphate, and further forming a second protective layer containing a specific hydrophilic resin on the first protective layer surface, the hydrophilic resin contained in the second protective layer comprising at least one polymer having non-cross-linked hydrophilic functional groups and reactive functional groups which are different from the hydrophilic functional groups and are at least partially cross-linked. The process of the present invention has been completed based on the above-mentioned finding.

The aluminum-containing metal material usable for the surface-treating process of the present invention is selected from aluminum materials and aluminum alloy materials. The aluminum alloy is preferably selected from aluminum-magnesium alloys, aluminum-silicon alloys and aluminum-manganese alloys. These aluminum-containing metal materials include shaped materials, for example, tubes, fins and hollow plates, for heat exchangers such as used in air conditioners.

In the surface-treating process of the present invention, a chemical etching treatment is applied to at least portions of an aluminum-containing metal material.

The chemical etching treatment is carried out with a treating liquid which are preferably an aqueous acid solution containing at least one member selected from, for example, sulfuric acid, hydrofluoric acid, nitric acid, and phosphoric acid, or an aqueous alkaline solution containing at least one member selected from, for example, sodium hydroxide, potassium hydroxide and alkali metal phosphates.

In the surface-treating process of the present invention, the chemically etched surface of the aluminum-containing metal material is subjected to a first protective layer-forming step. The first protective layer is formed by a chemical conversion treatment with a first treating liquid containing at least one member selected from zirconium phosphate and titanium phosphate.

In the surface-treating process of the present invention, the first protective layer surface is further coated with a second protective layer. The second protective layer is formed from a second treating liquid containing a hydrophilic resin which comprises at least one polymer having at least one type of non-cross-linked hydrophilic functional groups and at least one type of reactive functional groups different from the hydrophilic functional groups, at least a portion of the reactive functional groups being cross-linked.

The individual steps of the surface-treating process of the present invention will be further explained in detail below.

Process Steps

Preferable steps of the surface-treating process of the present invention for an aluminum-containing metal material, particularly, an aluminum or an aluminum alloy-containing heat exchanger, are as follows.

① Chemical etching step
Treatment temperature: Room temperature to 80° C.
Treatment method: Immersion or spraying method ② Water-rinsing step
Treatment method: Immersion or spraying method ③ Chemical conversion treatment step (First protective layer-coating step)
Treatment temperature: 20 to 70° C.
Treatment method: Immersion or spraying method ④ Water-rinsing step
Treatment method: Immersion or spraying method ⑤ Hydrophilic coating layer-forming step
(Second protective layer-coating step)
Treatment temperature: Room temperature to 70° C.
Treatment method: Immersion or spraying method ⑥ Drying step
Treatment temperature: 100 to 300° C.

The chemical etching step ①, the water-rinsing step ② and ④, the first protective layer-coating step ③ and the second protective layer-coating step ⑤ of the surface-treating process of the present invention can be carried out by a spraying method or an immersion method.

Also, each of the water-rinsing steps ② and ④ can be carried out by a multi-stage rinsing method or a countercurrent rinsing method in which the rinsing water flows in a direction counter to the moving direction of the metal material. Also, the water rinsing step may be carried out at an increased temperature to enhance the water-rinsing effect.

Chemical Etching Step

The aluminum-containing metal material, particularly the aluminum or aluminum alloy heat exchanger, preferably comprises an aluminum alloy which has an appropriate mechanical strength and processability. Also, when the tubes and fins for the heat exchanger are formed from the aluminum or aluminum alloy, they pass through a soldering oven, etc. and thus the surface of the aluminum-containing metal heat exchanger before the surface treatment is applied, is unevenly solid with segregated alloy components or oxides. When the solid metal surface is coated with a first protective layer comprising zirconium phosphate and/or titanium phosphate and containing no hexavalent chromium, the first protective layer-forming reaction is carried out unevenly, and thus the resultant first protective layer is also uneven. Therefore, the first protective layer exhibits an unsatisfactory corrosion resistance and an insufficient adhesion to the second protective layer formed thereon.

In the surface-treating process of the present invention, the chemically etched surface can be coated with the first and second protective layers which are uniform, exhibit an excellent corrosion resistance, and can maintain a high hydrophilicity over a long period.

In the surface-treating process of the present invention for the aluminum-containing metal material, particularly the aluminum or aluminum alloy-containing heat exchanger, the treating liquid for the chemical etching step is classified into acid solutions and alkaline solutions.

The acid solutions for the chemical etching step preferably contain at least one member selected from mineral acids, for example, sulfuric acid, hydrofluoric acid, nitric acid and phosphoric acid.

The acid etching solution may contain an oxidizing agent selected from nitrite ions, hydrogen perioxide and ferric ions.

The alkaline solution for the chemical etching step preferably contains at least one member selected from sodium hydroxide, potassium hydroxide and alkali metal phosphates.

In the chemical etching step of the surface-treating process of the present invention, a surfactant may be added to the chemical etching liquid, to homogenize the chemical etching effect, and when aluminum is dissolved in the chemical etching liquid and the etching effect is decreased, a chelating agent for catching the dissolved aluminum may be added to the chemical etching liquid to prevent the decrease in the etching effect. In this case, the chelating agent for aluminum may be selected from citric acid, oxalic acid, tartaric acid, gluconic acid and salts of these acids.

The chemical etching step is preferably carried out at an etching temperature of 20 to 70° C., particularly 35 to 60° C. The temperature of the chemical etching liquid may be increased to more than 70° C. for enhancing the etching efficiency. However, when the etching liquid temperature is 80° C. or more, the water is rapidly evaporated and the etching temperature is easily changed, and thus the etching liquid temperature is preferably lower than 80° C.

In the process of the present invention, the chemical etching step is preferably carried out to such an extent that the reduction in weight of the aluminum-containing metal material due to the chemical etching reaches 0.02 to 20 $g/m^2$, more preferably 0.02 to 10 $g/m^2$.

Chemical Conversion Treatment Step

Formation of a First Protective Layer

In the surface treating process of the present invention for the aluminum-containing metal material, the chemical conversion treatment for forming a first protective layer can be carried out by using a trade reagent for the non-chromate chemical conversion treatment. For example, a surface-treating liquid containing a mixture of phosphate ions and a zirconium compound and/or a titanium compound in a specific mixing ratio or a surface treatment composition containing the above-mentioned mixture in a specific content is brought into contact with a desired portion of the chemically etched aluminum-containing metal material at a temperature of 20 to 70° C. for a certain time by an immersion or spraying method, to form a chemical conversion coating containing, as a principal component, zirconium phosphate and/or titanium phosphate on the surface of the aluminum-containing metal material.

Also, in the chemical conversion reaction for forming the first protective layer in accordance with the process of the present invention, the treating liquid may contain at least one member selected from fluorides, for example, hydrofluoric acid and oxidants, for example, nitrite ions and hydrogen peroxide, to enhance the chemical conversion coating-forming efficiency. Also, to prevent a decrease in reaction efficiency due to the dissolution of aluminum in the treating liquid, a chelating agent for catching the dissolved aluminum may be added to the treating liquid. For this purpose, the chelating agent preferably comprises at least one member selected from citric acid, oxalic acid, tartaric acid, phosphoric acid, gluconic acid and salts of the above-mentioned acids.

In the process of the present invention, the chemical conversion treatment is carried out at a temperature of from room temperature to 80° C., usually room temperature of 10 to 40° C. The treating liquid temperature may be higher than 80° C., to promote the chemical conversion reaction and enhance the operation efficiency. Generally, when the chemical conversion treatment temperature is more than 80° C., water in the treating liquid may be rapidly evaporated and thus the composition of the treating liquid may be changed to an unbalanced composition.

Hydrophilic Coating-forming Step

Formation of a Second Protective Layer

The resin coating layer forming the second protective layer of the present invention comprises a hydrophilic resin having at least one type of reactive functional groups (b) at least a portion of which is cross-linked and at least one type of hydrophilic functional groups (a) which are not cross-linked. The non-cross-linked hydrophilic functional groups are preferably selected from a primary amino group, secondary amino groups tertiary amino groups, quaternary ammonium salt groups, an amide group, a carboxyl group, a sulfonic acid group, a phosphoric acid group and a hydroxyl group.

The reactive functional groups (b) are different from the hydrophilic functional group (a) and can be cross-linked with a cross-linking agent. When the hydrophilic resin is prepared from a mixture of a hydrophilic polymer having the non-cross-linked hydrophilic functional groups (a) and a reactive polymer having the reactive functional groups (b), the reactive polymer (b) may be selected from water-soluble, cross-linking polymers (P1), for example, homopolymers and copolymers of addition-polymerizable monomers having at least one type of hydrophilic groups, selected from amido, hydroxyl and carboxyl groups, for example, acrylamide, 2-hydroxyethyl acrylate, acrylic acid and maleic acid, and copolymers of the above-mentioned monomer with other addition-polymerizable monomers, and condensation-polymerized polymers, for example, water-soluble polyamides and water-soluble nylons, and the hydrophilic polymer (a) may be selected from water-soluble, non-cross-linked polymers (P2), for example, homopolymers and copolymers of addition-polymerizable monomers having at least one type of hydrophilic groups, for example, sulfonic acid groups and sulfonate salt groups, for example, vinylsulfonic acid, sulfoethyl acrylate, and 2-acrylamido-2-methylpropane-sulfonic acid, and copolymers of the above-mentioned addition-polymerizable monomer with other monomers. There is no limitation to the mixing ratio of the polymer (P2) to the polymer (P1). Usually, the hydrophilic polymer (P2) is mixed in an amount of 1 to 200 parts by weight with 100 parts by weight of the reactive polymer (P1).

As a water-soluble polymer (P3) having both the hydrophilic functional groups (a) and the reactive functional groups (b), a polymer prepared by introducing hydrophilic, non-cross-linking groups, for example, sulfonic acid groups or sulfonate salt groups into moleculars of the water-soluble cross-linking polymers can be used.

As a water-soluble polymer (P4) having polyethyleneoxide chain groups (c) located in molecular chain skeltons and capable of forming a flexible coating having a high softness, water-soluble nylons and polyethylene glycol can be used.

There is no limitation to the contents of the polymer (P3) and the polymer (P4). Preferably, the polymer (P4) is used in an amount of 50 to 300 parts by weight per 100 parts by weight of the polymer (P1) and the polymer (P4) is used in an amount of 20 to 200 parts per 100 parts by weight of the polymer (P3).

A water-soluble polymer (P5) having the hydrophilic functional groups (a), the reactive functional groups (b) and the polyethyleneoxide groups (c), may be selected from copolymers of addition-polymerizable monomers having acrylamide groups and tertiary amine groups with another addition-polymerizable monomers, for example, polyethyleneglycol acrylates and polyethyleneglycol acrylate-alkylphenylether, water-soluble polyamides produced by a terpolymerization of aminoethylpiperazine with polyethylene-glycoldiamine and adipic acid.

In the process of the present application, the second protective layer containing the hydrophilic resin comprising the above-mentioned component polymers preferably has a softening temperature of 100° C. or less. When the softening temperature is higher than 100° C., the resultant second protective layer may exhibit an insufficient effect on the prevention of coating-removal phenomenon.

The cross-linking agent reactive to the reactive functional group (b) is preferably selected from those capable of cross-linking with at least one hydrophilic reactive group selected from amide, hydroxyl and carboxyl groups but not reactive to the hydrophilic functional groups (a). The cross-linking agent is preferably selected from organic compounds having isocyanate, glycidyl, aldehyde, and/or methylol groups, and cross-linking metal compounds, for example, chromium, zirconium and/or titanium compounds. There is no limitation to the content of the cross-linking agent in the second protective layer. Usually the cross-linking agent is employed in an amount of 0.001 to 100 parts by weight per 100 parts by weight of the polymer (P1), (P3) or (P5).

The second protective layer preferably contains an antibacterial agent which does not thermally decompose at a temperature of 100° C. or less. The antibacterial agent contributes to preventing the growth of microorganisms in the gaps between the fins of the heat exchanger and the generation of putrid odor from the metabolic product of the microorganisms. There is no limitation to the content of the antibacterial agent in the second protective layer. Usually, the antibacterial agent is contained in a content of 0.1 to 30 parts by weight per 100 parts by weight of the hydrophilic resin, in the second protective layer.

The second protective layers optionally contains, in addition to the above-mentioned components, at least one member selected from anti-corrosion agents, leveling agents, fillers, coloring materials, surfactants and anti-foaming agents, in an amount in which the coating performance of the second protective layer is not affected.

The solid content of viscosity of the coating liquid for the second protective layer is variable in response to the coating method and the target thickness of the second protective layer. Preferably, the thickness of the second protective layer after drying is 0.05 to 5 μm, more preferably 0.1 to 2 μm. When the thickness is less than 0.05 μm, the resultant second protective layer may exhibit an insufficient hydrophilicity. Also, when the thickness is more than 5 μm, the resultant second protective layer may exhibit an unsatisfactory heat-conductivity.

Generally, for the aluminum-containing metal material, particularly the aluminum or aluminum alloy heat exchanger, aluminum alloys which have a high mechanical strength and an appropriate workability are preferably used.

When the aluminum-containing metal tubes and fins are subjected to a forming procedure, since they pass through a soldering oven, the surfaces of the aluminum-containing metal tubes and fins of the heat exchanger before the surface treatment are unevenly soiled by the segregation and oxides of alloy components.

If the solid surface of the aluminum-containing metal material is directly coated with a first protective layer containing zirconium phosphate or titanium phosphate, the coating-forming reaction on the aluminum-containing metal material surface is carried out unevenly, and thus the resultant first protective layer is non-uniform. Therefore, the first protective layer per se exhibit an unsatisfactory corrosion resistance and/or an insufficient adhesion to the second recording layer formed on the first protective layer.

Further, by forming a second protective layer comprising an aqueous polymer, to enhance the flexibility of the coating, the resultant coating accumulated on curved portions of the heat exchanger can be prevented from scattering. Therefore, the first and second protective layers in accordance with the present invention are appropriate to form a protective composite coating for the aluminum-containing metal heat exchanger.

Also, even if the coating has, as a whole, a decreased softening temperature, and the softened coating is formed on a curved portion of the aluminum-containing metal material, the soft coating is broken by repeated shrinkage and expansion thereof occurred due to a stress created by repeated cooling and drying operations, and thus, the odor generation due to the metal or metal oxide surface exposed through the broken coating can be prevented.

EXAMPLES

The usefulness of the process of the present invention will be further explained by the following examples in comparison with the comparative examples.

Example 1

An aluminum heat exchanger was immersed in an aqueous solution of 2% by weight of sulfuric acid at a temperature of 60° C. for 2 minutes, to subject the heat exchanger surface to an etching step. In this step, the reduction in weight of the aluminum heat exchanger was 0.1 g/m$^2$.

The heat exchanger was rinsed with tap water for 30 seconds. The aluminum heat exchanger was immersed in a titanium phosphate chemical convention treatment liquid (made by NIHON PARKERIZING CO.) and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 5% by weight of a total solid content comprising 100 parts by weight of a polyacrylamide (made by DAIICHI KOGYOSEIYAKU K.K.), 110 parts by weight of a polyvinyl-sulfonic acid (made by NIHON SHOKUBAI K.K.), 50 parts by weight of a non-ionic, water-soluble nylon (made by TORAY K.K.) containing polyethyleneoxide groups in molecular skeletons thereof, and 30 parts by weight of a cross-linking agent consisting of chromium biphosphate, at a temperature of 25° C. for 30 seconds. The aluminum heat exchanger was removed from the treating liquid, the amount of the treating liquid remaining on the heat exchanger surface being controlled by air-blowing, and heat-dried in an air-circulating oven controlled at a temperature of 140° C. for 20 minutes. A second protective layer was formed, to a thickness of 0.8 μm, on the first protective layer.

Example 2

An aluminum heat exchanger was immersed in an aqueous solution of 0.5% by weight of hydrofluoric acid at a temperature of 50° C. for 30 seconds, to subject the heat exchanger surface to an etching step. In this step, the reduction in weight of the aluminum heat exchanger was 1.5 g/m$^2$.

The heat exchanger was rinsed with tap water for 30 seconds. The aluminum heat exchanger was immersed in a zirconium phosphate chemical conversion treatment liquid (made by NIHON PARKERIZING CO.) and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 3.5% by weight of a total solid content comprising 100 parts by weight of a cationic, water-soluble nylon containing, in the molecular skeletons, polyethyleneoxide groups (made by TORAY K.K.) and 95 parts by weight of a cross-linking agent consisting epoxy-modified polyamide (made by TOHO KAGAKUKOGYO K.K.), at a temperature of 25° C. for 30 seconds. The aluminum heat exchanger was removed from the treating liquid, the amount of the treating liquid remaining on the heat exchanger surface being controlled by air-blowing, and heat-dried in an air-circulating oven, controlled to a temperature of 140° C., for 20 minutes. A second protective layer was formed, to a thickness of 0.7 μm, on the first protective layer.

Example 3

An aluminum heat exchanger was immersed in an aqueous solution containing 2% by weight of sulfuric acid and fluorine (F) ions in a content of 20 ppm determined by a fluroine ion meter at a temperature of 60° C. for 2 minutes, to subject the heat exchanger surface to an etching step. In this step, the reduction in weight of the aluminum heat exchanger was 0.2 g/m$^2$.

The heat exchanger was rinsed with tap water for 30 seconds. The aluminum heat exchanger was immersed in the same titanium phosphate chemical conversion treatment liquid as in Example 1, and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 1.5% by weight of a total solid content comprising 100 parts by weight of a 90% saponification product of polyvinyl acetate, 100 parts by weight of a copolymer of methacrylic acid (60 molar %) with sulfoethyl acrylate (40 molar %), 50 parts by weight of a polyethylene glycol and 15 parts by weight of a cross-linking agent consisting of a blocked isocyanate (made by DAIICHI KOGYO K.K.), at a temperature of 25° C. for 30 seconds. The aluminum heat exchanger was removed from the treating liquid, the amount of the treating liquid remaining on the heat exchanger surface being controlled by air-blowing, and heat-dried in an air-circulating oven controlled to a temperature of 140° C. for 20 minutes. A second protective layer was formed in a thickness of 0.3 μm on the first protective layer.

Example 4

An aluminum heat exchanger was immersed in an aqueous solution containing 0.5% by weight of sodium phosphate, 0.13% by weight of phosphonic acid and 0.1% by weight of sodium gluconate at a temperature of 60° C. for 5 minutes, to subject the heat exchanger surface to an etching step. In this step, the reduction in weight of the aluminum heat exchanger was 2.0 g/m$^2$.

The heat exchanger was rinsed with tap water for 30 seconds. The aluminum heat exchanger was immersed in the same zirconium phosphate chemical conversion treatment liquid as in Example 2, and then was rinsed with tap water for 30 seconds, to form a first protective layer consisting of a chemical conversion coating in an amount of 10 mg/M$^2$.

The aluminum heat exchanger coated with the first protective layer was immersed in an aqueous treating liquid containing 5% by weight of a total solid content comprising 100 parts by weight of a copolymer of acrylamide (90 molar %) with sodium 2-acrylamido-2-methylpropanesulfonate, 100 parts by weight of polyvinylsulfonic acid, 50 parts by weight of a nonionic, water-soluble nylon and 75 parts by weight of a cross-linking agent consisting of zirconium ammonium carbonate, at a temperature of 35° C. for 30 seconds. The aluminum heat exchanger was removed from the treating liquid, the amount of the treating liquid remaining on the heat exchanger surface being controlled by air-blowing, and heat-dried in an air-circulating oven controlled at a temperature of 140° C. for 20 minutes. A second protective layer was formed in a thickness of 0.8 μm on the first protective layer.

Example 5

An aluminum heat exchanger was immersed in an aqueous solution of 0.5% by weight of NaOH, 0.76% by weight of phosphonic acid and 0.03% by weight of sodium gluconate at a temperature of 50° C. for 5 minutes, to subject the heat exchanger surface to an etching step. In this step, the reduction in weight of the aluminum heat exchanger was 6 g/m$^2$.

The heat exchanger was rinsed with tap water for 30 seconds. The aluminum heat exchanger was immersed in the same zirconium phosphate chemical conversion treatment liquid as in Example 2, and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 10% by weight of a total solid content comprising 100 parts by weight of a nonionic, water-soluble nylon (made by TORAY K.K.), 200 parts by weight of a copolymer of acrylic acid (20 molar %) with sulfoethyl acrylate (80 molar %), and 120 parts by weight of a cross-linking agent consisting of pentaerythritol polyglycidylether, at a temperature of 35° C. for 30 seconds. The aluminum heat exchanger was removed from the treating liquid, the amount of the treating liquid remaining on the heat exchanger surface being controlled by air-blowing, and heat-dried in an air-circulating oven controlled at a temperature of 140° C. for 20 minutes. A second protective layer was formed in a thickness of 1.2 μm on the first protective layer.

Example 6

An aluminum heat exchanger was immersed in an aqueous solution of 10% by weight of nitric acid at a temperature of 50° C. for 60 seconds, to subject the heat exchanger surface to an etching step. In this step, the reduction in weight of the aluminum heat exchanger was 4 g/m$^2$.

The heat exchanger was rinsed with tap water for 30 seconds. The aluminum heat exchanger was immersed in the same titanium phosphate chemical conversion treatment liquid as in Example 1, and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 4% by weight of a total solid content comprising 100 parts by weight of a polyacrylamide (made by DAIICHI KOGYOSEIYAKU K.K.), 110 parts by weight of a polyvinyl-sulfonic acid (made by NIHON SHOKUBAI K.K.), 50 parts by weight of a nonionic, water-soluble nylon (made by TORAY K.K.) containing polyethyleneoxide groups in molecular skeletons thereof, and 20 parts by weight of a cross-linking agent consisting of chromium fluoride, at a temperature of 25° C. for 30 seconds. The aluminum heat exchanger was removed from the treating liquid, the amount of the treating liquid remaining on the heat exchanger surface being controlled by air-blowing, and heat-dried in an air-circulating oven controlled to a temperature of 140° C. for 20 minutes. A second protective layer was formed in a thickness of 0.8 μm on the first protective layer.

Example 7

An aluminum heat exchanger was immersed in an aqueous solution containing 0.5% by weight of potassium hydroxide, 0.76% by weight of phosphonic acid and 0.2% by weight of sodium gluconate at a temperature of 60° C. for 60 seconds, to subject the heat exchanger surface to an etching step. In this step, the reduction in weight of the aluminum heat exchanger was 1.5 g/m$^2$.

The heat exchanger was rinsed with tap water for 30 seconds. The aluminum heat exchanger was immersed in the same zirconium phosphate chemical conversion treatment liquid as in Example 2, and then was rinsed with tap water for 30 seconds, to form a first protective layer consisting of a chemical conversion coating in an amount of 10 mg/m$^2$.

The aluminum heat exchanger coated with the first protective layer was immersed in an aqueous treating liquid containing 5% by weight of a total solid content comprising 100 parts by weight of a copolymer of acrylamide (90 molar %) with sodium 2-acrylamido-2-methylpropanesulfonate (10 molar %), 100 parts by weight of a polyvinylsulfonic acid, 30 parts by weight of a nonionic, water-soluble nylon, and 75 parts by weight of a cross-linking agent consisting of zirconium ammonium carbonate, at a temperature of 35° C. for 30 seconds. The aluminum heat exchanger was removed from the treating liquid, the amount of the treating liquid remaining on the heat exchanger surface being controlled by air-blowing, and heat-dried in an air-circulating oven, controlled to a temperature of 140° C., for 20 minutes. A second protective layer was formed, to a thickness of 1.2 μm, on the first protective layer.

Comparative Example 1

An aluminum heat exchanger was immersed, without applying the etching step and the first protective layer-coating step, in an aqueous treating liquid containing 5% by weight of a total solid content comprising 100 parts by weight of a polyacrylamide (made by DAIICHI KOGYOSEIYAKU K.K.), 110 parts by weight of a polyvinyl-sulfonic acid (made by NIHON SHOKUBAI K.K.), 50 parts by weight of a nonionic, water-soluble nylon containing polyethyleneoxide groups in molecular skeletons thereof (made by TORAY K.K.), and 30 parts by weight of a cross-linking agent consisting of chromium biphosphate, at a temperature of 25° C. for 30 seconds. The aluminum heat exchanger was removed from the treating liquid, the amount of the treating liquid remaining on the heat exchanger surface being controlled by air-blowing, and heat-dried in an air-circulating oven, controlled to a temperature of 140° C., for 20 minutes. A second protective layer was formed in a thickness of 0.8 μm on the first protective layer.

Comparative Example 2

An aluminum heat exchanger was washed with hot water in place of the chemical etching. The reduction in weight was 0.01 g/m$^2$. The hot water-washed heat exchanger was immersed in the same zirconium phosphate chemical conversion treatment liquid (made by NIHON PARKERIZING CO.) as in Example 2, and then was rinsed with tap water for 30 seconds, to form a first protective layer consisting of a chemical conversion coating in an amount of 20 mg/m$^2$.

The aluminum heat exchanger coated with the first protective layer was immersed in an aqueous treating liquid containing 3.5% by weight of a total solid content comprising 100 parts by weight of a cationic, water-soluble nylon containing polyethyleneoxide groups in molecular skeletons thereof (made by TORAY K.K.), and 95 parts by weight of a cross-linking agent consisting of an epoxy-modified polyamide (made by TOHO KAGAKUKOGYO K.K.), at a temperature of 25° C. for 30 seconds. The aluminum heat exchanger was removed from the treating liquid, the amount of the treating liquid remaining on the heat exchanger surface is controlled by air-blowing, and heat-dried in an air-circulating oven controlled at a temperature of 140° C. for 20 minutes. A second protective layer was formed in a thickness of 0.7 μm on the first protective layer.

Comparative Example 3

An aluminum heat exchanger was immersed in an aqueous solution of 1% by weight of hydrofluoric acid (HF) at room temperature for 30 seconds, to fully etch the heat exchanger surface. In this step, the reduction in weight of the aluminum heat exchanger was 3 g/m$^2$.

The heat exchanger was rinsed with tap water for 30 seconds. The aluminum heat exchanger was immersed in the same titanium phosphate chemical conversion treatment liquid as in Example 1, and then was rinsed with tap water for 30 seconds, to form a first protective layer consisting of chemical conversion coating in an amount of 10 mg/m$^2$.

The aluminum heat exchanger coated with the first protective layer was dewatered by air-blowing, and heat-dried in an air-circulating oven controlled at a temperature of 140° C. for 20 minutes.

Tests

The heat exchangers surface treated in Examples 1 to 7 and Comparative Examples 1 to 3 was subjected to the following tests and evaluated for corrosion resistance, hydrophilicity and odor generation-preventing property.

(1) Corrosion Resistance

A specimen was subjected to a corrosion resistance test in accordance with the salt water-spray test of Japanese Industrial Standard (JIS) Z 2371, for 72 hours.

After the 72 hour salt water spray test was completed, the-corroded area of the specimen surface was measured in % based on the total area of the specimen.

The corrosion resistance of the specimen was evaluated in accordance with the following evaluation standard.

Evaluation standard of corrosion resistance

| Class | Corrosion area |
|---|---|
| 5 | No corrosion |
| 4 | 10% or less |
| 3 | More than 10% but not more than 25% |
| 2 | More than 25% but not more than 50% |
| 1 | More than 50% |

(2) Hydrophilicity

A specimen was immersed in a deionized water flowing at a flow rate of 0.5 liter/min for 72 hours. Before and after the immersion, the water-contact angle of a fin surface of the specimen was measured by a face-contact angle tester (model: CA-P, made by KYOWA KAIMENKAGAKU K.K.). The hydrophilicity of the specimen was evaluated under the following evaluation standard.

Evaluation standard of hydrophilicity

| | Water-contact angle (degree) | |
|---|---|---|
| Class | Before immersion in water | After immersion in water |
| 3 | Less than 10 degrees | Less than 50 degrees |
| 2 | 10 degrees or more and less than 50 degrees | 50 degrees or more and less than 70 degrees |
| 1 | 50 degrees or more | 70 degrees or more |

(3) Odor Generation-preventing Property.

A specimen was immersed in deionized water flowing at a flow rate of 0.5 liter/min for 72 hours.

The odor generation-preventing property of the water immersion-treated specimen was evaluated in organoleptic manner under the following evaluation standard.

| Class | Odor generation |
|---|---|
| 5 | No odor |
| 4 | Very slight odor |
| 3 | Slight odor |
| 2 | Certain odor |
| 1 | Strong odor |

In Tables 1 and 2, the composition of each of the protective coating-forming liquids of Examples 1 to 7 and Comparative Examples 1 to 3 and the evaluation results thereof are shown.

TABLE 1

| Example No. | Chemical etching liquid | First protective layer (chemical conversion) - forming liquid | Second protective layer (hydrophilic resin) - forming liquid | Test result: Corrosion resistance | Water contact angle (°): Before water immersion | Water contact angle (°): After water immersion | Prevention of odor generation |
|---|---|---|---|---|---|---|---|
| Example | | | | | | | |
| 1 | 2% sulfuric acid | Titanium phosphate | Polyacrylamide<br>Polyvinylsulfonic acid<br>Nonionic, water-soluble nylon<br>Chromium biphosphate (cross-linking agent) | 5 | 3 | 3 | 4–5 |
| 2 | 0.5% hydrofluoric acid (HF) | Zirconium phosphate | Cationic, water-soluble nylon<br>Epoxy-modified polyamide (cross-linking agent) | 5 | 3 | 3 | 4–5 |
| 3 | 2% sulfuric acid<br>20 ppm HF | Titanium phosphate | 90% saponification product of polyvinyl acetate<br>Methacrylic acid-sulfoethyl acrylate copolymer<br>Blacked isocyanate (cross-linking agent) | 5 | 3 | 3 | 4–5 |
| 4 | 0.5% sodium phosphate<br>0.13% phosphonic acid<br>0.1% sodium gluconate | Zirconium phosphate | Acrylamide-sodium methylpropanesulfonate copolymer<br>Nonion, water-soluble nylon<br>Zirconium carbonate (cross-lining agent) | 5 | 3 | 3 | 4–5 |
| 5 | 0.5% sodium hydroxide<br>0.76% phosphonic acid<br>0.03% sodium gluconate | Zirconium phosphate | Nonionic, water-soluble nylon<br>Acrylic acid-sulfoethyl acrylate copolymer<br>Pentaerythritol polyglycidyl ether (cross-linking agent) | 5 | 3 | 3 | 4–5 |
| 6 | 10% nitric acid | Titanium phosphate | Polyacrylamide<br>Polyvinylsulfonic acid<br>Nonionic, water-soluble nylon<br>Chromium fluoride (cross-linking agent) | 5 | 3 | 3 | 4–5 |
| 7 | 0.5% potassium hydroxide<br>0.76% phosphonic acid<br>0.2% sodium gluconate | Zirconium phosphate | Acrylamide-sodium methylpropanesulfonate copolymer<br>Nonionic, water-soluble nylon<br>Zirconium carbonate (cross-linking agent) | 5 | 3 | 3 | 4–5 |

TABLE 2

| Example No. | Chemical etching liquid | First protective layer (chemical conversion) - forming liquid | Second protective layer (hydrophilic resin) - forming liquid | Test result: Corrosion resistance | Water contact angle (°): Before water immersion | Water contact angle (°): After water immersion | Prevention of odor generation |
|---|---|---|---|---|---|---|---|
| Comparative Example | | | | | | | |
| 1 | — | — | Poly-acrylamide<br>Polyvinylsulfonic acid<br>Nonionic, water-soluble nylon<br>Chromium biphosphate (cross-linking agent) | 1 | 3 | 1 | 4 |
| 2 | *1 | Zirconium phosphate | Cationic, water-soluble | 2 | 3 | 2 | 2 |

TABLE 2-continued

| Example No. | Chemical etching liquid | First protective layer (chemical conversion) - forming liquid | Second protective layer (hydrophilic resin) - forming liquid | Test result: Corrosion resistance | Water contact angle (°): Before water immersion | Water contact angle (°): After water immersion | Prevention of odor generation |
|---|---|---|---|---|---|---|---|
| | | | nylon<br>Epoxy-modified polyamide<br>(cross-linking agent) | | | | |
| 3 | 1.0% HF | Titanium phosphate | — | 1–2 | 1 | 1 | 1 |

Note: *1 . . . In comparative Example 2, a hot water-washing was applied in place of the chemical etching. The reduction in weight was 0.01 g/m$^2$.

Tables 1 and 2 clearly show that the protective coatings formed in Examples 1 to 7 in accordance with the process of the present invention exhibited an excellent corrosion resistance, hydrophilicity and prevention of odor generation in durability test. However, in Comparative Examples 1 to 3, the resultant protective layers are unsatisfactory in at least one item of the corrosion resistance, hydrophilicity after durability test, and the odor generation-preventing effect.

In the surface-treating method of the present invention for the aluminum-containing metal material, the combination of the first protective layer with the second protective layer, formed on the chemically etched surface of the aluminum-containing metal material has a high uniformity, exhibits a high corrosion resistance and can maintain the hydrophilicity and the odor-generation-preventing effect at high level over a long period. Also, when an aqueous polymer capable of enhancing the flexibility of the second protective layer is added to the second protective layer, the resultant protective coating, for example, formed on a curved portion of a heat exchanger, can exhibit a high resistance to scattering. Also, since the protective coating contains no hexavalent chromium, the waste-water-treating cost is low. Accordingly, the surface-treating process of the present invention is adequate as a post-treatment process for aluminum-containing metal heat exchangers.

What we claim is:

1. A process for surface-treating an aluminum-containing metal material, comprising the steps of:

chemically etching at least a portion of a surface of an aluminum-containing metal material to an extent such that the material exhibits a reduction in weight of 0.02 to 20 g/m$^2$;

applying a chemical conversion treatment to the chemically etched surface of the aluminum-containing metal material with a chemical conversion treating liquid containing at least one member selected from the group consisting of zirconium phosphate and titanium phosphate, to form a first protective layer; and forming a second protective layer containing a hydrophilic resin cross-linked with a cross-linking agent on the first protective layer, wherein the cross-linking agent comprises at least one member selected from chromium compounds, zirconium compounds and titanium compounds; the cross-linked hydrophilic resin contained in the second protective layer comprises (a) non-cross-linked hydrophilic functional groups selected from the group consisting of primary amino groups, secondary amino groups, tertiary amino groups, quaternary ammonium salt groups, an amide group, a carboxyl group, a sulfonic acid group, phosphoric acid group and a hydroxyl group, and being non-reactive to the cross-linking agent; and (b) reactive functional groups being reactive to the cross-linking agent, selected from the group consisting of an amide group, a hydroxyl group and a carboxyl group, and being different from the hydrophilic functional groups (a); and at least a portion of the reactive functional groups (b) is cross-linked with the cross-linking agent.

2. The surface-treating process for the aluminum-containing metal material as claimed in claim 1, wherein the second protective layer is formed by coating the first protective layer with a resin treating liquid comprising at least one polymer having one or more hydrophilic functional groups and one or more reactive functional groups different from the hydrophilic functional groups and a cross-linking agent comprising at least one cross-linking compound reactive to the reactive functional groups but not reactive to the hydrophilic functional groups; and heat-drying the resultant resin treating liquid layer.

3. The surface-treating process for the aluminum-containing metal material as claimed in claim 1, wherein the second protective layer is formed by coating the first protective layer with a resin treating liquid containing at least one hydrophilic polymer having one or more hydrophilic functional groups, at least one reactive polymer having one or more reactive functional groups different from the hydrophilic functional groups, and a cross-linking agent comprising at least one cross-linking compound reactive to the reactive functional groups but not reactive to the hydrophilic functional groups; and heat-drying the resultant resin treating liquid layer.

4. The surface-treating process for the aluminum-containing metal material as claimed in claim 1, wherein the second protective layer is formed by coating the first protective layer with a resin treating liquid containing a cross-linking agent comprising at least one cross-linking compound having one or more hydrophilic functional groups and one or more cross-linking functional groups non-reactive to the hydrophilic functional groups, and at least one polymer having one or more reactive functional groups different from the hydrophilic functional groups of the cross-linking compound and reactive to the cross-linking functional groups of the cross-linking compound; and heat-drying the resultant resin treating liquid layer.

5. The surface-treating process for the aluminum-containing metal material as claimed in claim 1, wherein the aluminum-containing metal material is a heat-exchanger having solder-bonded tubes and fins comprising aluminum or an aluminum alloy.

6. The surface-treating process for the aluminum-containing metal material as claimed in claim 1, wherein the chemical etching step is carried out by applying an aqueous acid solution to said surface of the aluminum-containing metal material, the aqueous acid solution containing at least one member selected from the group consisting of sulfuric acid, hydrofluoric acid, nitric acid, and phosphoric acid, or an aqueous alkaline solution containing at least one member selected from the group consisting of sodium hydroxide, potassium hydroxide and alkali metal phosphatase.

* * * * *